US012325562B2

(12) United States Patent
Yan et al.

(10) Patent No.: US 12,325,562 B2
(45) Date of Patent: Jun. 10, 2025

(54) SELF-LOCKING SUBPACKAGING BOTTLE

(71) Applicant: DIAM DISPLAY (CHINA) CO., LTD., Jiangsu (CN)

(72) Inventors: Weimin Yan, Jiangsu (CN); Wei Lu, Jiangsu (CN)

(73) Assignee: DIAM DISPLAY (CHINA) CO., LTD., Jiangsu (CN)

( * ) Notice: Subject to any disclaimer, the term of this patent is extended or adjusted under 35 U.S.C. 154(b) by 0 days.

(21) Appl. No.: 18/037,774

(22) PCT Filed: May 23, 2022

(86) PCT No.: PCT/CN2022/094440

§ 371 (c)(1),
(2) Date: May 19, 2023

(87) PCT Pub. No.: WO2023/123832

PCT Pub. Date: Jul. 6, 2023

(65) Prior Publication Data

US 2024/0367873 A1 Nov. 7, 2024

(30) Foreign Application Priority Data

Dec. 31, 2021 (CN) ..... 202111662713.0

(51) Int. Cl.
*B65D 47/26* (2006.01)
*B65D 41/34* (2006.01)

(52) U.S. Cl.
CPC ..... *B65D 47/265* (2013.01); *B65D 41/34* (2013.01)

(58) Field of Classification Search
CPC ..... B65D 43/20; B65D 43/12; B65D 50/061; B65D 50/041; B65D 41/34; B65D 47/263;

(Continued)

(56) References Cited

U.S. PATENT DOCUMENTS 10,183,304 B2 * 1/2019 Puviland ..... B05B 11/026
10,633,151 B2 * 4/2020 Philip ..... B65D 50/041

(Continued)

FOREIGN PATENT DOCUMENTS

CN 102233971 11/2011
CN 102233972 11/2011

(Continued)

OTHER PUBLICATIONS

"International Search Report (Form PCT/ISA/210) of PCT/CN2022/094440," mailed on Sep. 30, 2022, pp. 1-5.

(Continued)

*Primary Examiner* — Anthony D Stashick
*Assistant Examiner* — Raven Collins
(74) *Attorney, Agent, or Firm* — JCIPRNET

(57) ABSTRACT

A self-locking subpackaging bottle comprising a bottle body, a bottle cap and an adapter is provided. The bottle cap comprises a receiving cap and a rotating cap sequentially arranged at a front end of the bottle body; the adapter comprises an adapter cap, a rotating ring and a fixing ring which are coaxially connected, the adapter cap comprises an annular cap, a first bearing arranged on an inner wall of the annular cap and a support ring arranged above the first bearing, the rotating ring is rotatably connected to the interior of the annular cap through the first bearing, and the fixing ring is connected to the interior of the annular cap through the support ring; and an inner wall of the rotating ring meshes with an outer wall of the rotating cap, and an inner wall of the fixing ring meshes with an outer wall of the receiving cap.

9 Claims, 5 Drawing Sheets

(58) Field of Classification Search
CPC . B65D 47/265; B65D 47/266; G06G 10/0831
USPC ..... 215/217, 223; 220/345.4, 345.6, 345.1
See application file for complete search history.

(56) References Cited

U.S. PATENT DOCUMENTS

| | | | | |
|---|---|---|---|---|
| 2002/0079704 | A1 | 6/2002 | Rutter et al. | |
| 2022/0039567 | A1* | 2/2022 | Weitsman ..... | A47G 1/205 |

FOREIGN PATENT DOCUMENTS

| | | |
|---|---|---|
| CN | 210437703 | 5/2020 |
| CN | 114379829 | 4/2022 |
| CN | 216916389 | 7/2022 |
| EP | 0881157 | 12/1998 |

OTHER PUBLICATIONS

"Written Opinion of the International Searching Authority (Form PCT/ISA/237) of PCT/CN2022/094440," mailed on Sep. 30, 2022, pp. 1-4.

* cited by examiner

SELF-LOCKING SUBPACKAGING BOTTLE

CROSS-REFERENCE TO RELATED APPLICATION

This application is a 371 of international application of PCT application serial no. PCT/CN2022/094440, filed on May 23, 2022, which claims the priority benefit of China application no. 202111662713.0, filed on Dec. 31, 2021. The entirety of each of the above mentioned patent applications is hereby incorporated by reference herein and made a part of this specification.

TECHNICAL FIELD

The invention discloses a self-locking subpackaging bottle, and relates to the technical field of subpackaging of liquid or emulsion products.

RELATED ART

At present, the quantitative subpackaging of cosmetic emulsions and solutions is basically realized in canning factories, which features fixed volume and large canning and subpackaging equipment, which is not suitable for subpackaging in stores. Specifically, the customization requirement of customers cannot be met, subpackaging experience of customers cannot be realized, and a switch of an existing product subpackaging system may be turned on accidentally, which will make perfume flow out to cause waste. In another word, the switch does not have the function of being turned on when used and locked when unused.

SUMMARY OF INVENTION

Aiming at the above defects in the background art, the invention provides a self-locking subpackaging bottle with a simple structure and a self-locking switch.

In order to achieve the above purpose, the technical scheme adopted by the invention is as follows: a self-locking subpackaging bottle comprises a bottle body, a bottle cap and an adapter;

the bottle cap comprises a receiving cap and a rotating cap, the receiving cap and the rotating cap are sequentially arranged at a front end of the bottle body, and a snap joint is arranged between the receiving cap and the rotating cap; the snap joint comprises an annular groove formed in an outer wall of a front end of the receiving cap and an annular protrusion formed on an inner wall of the rotating cap, the rotating cap rotates relative to the receiving cap through the cooperation of the annular protrusion and the annular groove, the rotating cap is sleeved outside the front end of the receiving cap, through holes are formed in the receiving cap and the rotating cap, and the rotating cap and the receiving cap can be made of injection molding materials;

the adapter comprises an adapter cap, a rotating ring and a fixing ring which are coaxially connected, the rotating ring is rotatably connected to the adapter cap, and the fixing ring is fixedly connected to the adapter cap;

the adapter cap comprises an annular cap, a first bearing and a support ring, the first bearing is arranged on an inner wall of the annular cap, the support ring is arranged above the first bearing, the support ring is connected to the annular cap by screws, the rotating ring is rotatably connected to the interior of the annular cap through the first bearing, and the fixing ring is connected to the interior of the annular cap through the support ring; and an inner wall of the rotating ring meshes with an outer wall of the rotating cap, an inner wall of the fixing ring meshes with an outer wall of the receiving cap, the positions of the fixing ring and the receiving cap are fixed, and the rotating ring is used to drive the rotating cap to rotate.

Further, the diameter of the outer wall of the receiving cap is greater than that of the rotating cap, which allows the rotating cap to easily extend downward into the inner wall of the rotating ring, and the receiving cap directly fits to the fixing ring above the rotating ring.

Further, the bottom of the inner wall of the annular cap is provided with an internal thread for connecting an empty bottle.

Further, the rotating ring comprises a handle, a first rotating sleeve, a connecting body and a second rotating sleeve, the first rotating sleeve and the second rotating sleeve are respectively connected to two sides of the connecting body, the handle is connected to the connecting body, the connecting body is connected to the first bearing through the second rotating sleeve, a notch is formed in the annular cap, the handle extends out of the adapter cap from the notch, and an initial end of the notch is L-shaped.

Further, an end, connected to the connecting body, of the handle is designed as an arc-shaped piece, the connecting body is connected to a limit screw, a round hole is formed in the arc-shaped piece, the diameter of the round hole is greater than that of the limit screw, and an elastic piece is arranged between the connecting body and the arc-shaped piece; two groups of elastic pieces are arranged at each end of the arc-shaped piece; and when the handle is located at the initial end of the notch, the outer elastic piece supports the arc-shaped piece upwards, and the inner elastic piece pulls the handle downwards and fits into a tail end of the L-shaped groove to limit the lateral position of the handle.

Further, a stopper is hinged to the outside of the adapter cap and comprises a connecting strip and a stopper strip, the middle of the connecting strip is hinged to the outside of the adapter cap, the stopper strip is arranged at one end of the connecting strip, and extends to the rotating ring through a stopper opening formed in the adapter cap, the connecting body of the rotating ring is provided with a recess matched with the stopper strip, and a reset spring is arranged between the stopper strip and the annular cap.

Further, the stopper strip is arranged in the diameter direction of the adapter cap, and the stopper strip is arranged at an end away from the adapter cap.

Further, a sealing gasket is arranged between the receiving cap and the rotating cap, the sealing gasket is provided with a through hole, the seal gasket is arranged at the bottom of the receiving cap, the through hole in the sealing gasket is aligned with the through hole in the receiving cap, and the through hole in the rotating cap is movable relative to the through hole in the receiving cap; the through hole comprises an air flow hole and a liquid flow hole; when the through hole in the rotating cap is misaligned with the through hole in the receiving cap, the bottle cap is closed; only when the rotating cap rotates and the inner through hole is aligned with the through hole in the receiving cap, can the bottle cap be in an open state; and the liquid flow hole is directly designed on the receiving cap, the air flow hole is connected to an air guide tube, and an air port at the other end of the air guide tube is at an air position of the inverted bottle body.

Further, the receiving cap is connected to the bottle body through an internal thread for fixing the bottle cap.

Operation steps: An empty bottle is connected to a screw thread at the bottom of the adapter cap; when the empty bottle rotates and rises, a bottle body of the empty bottle touches the hinged stopper, and the position of the connecting strip on the side of the bottle body rises and the position on the side of the stopper strip falls. Therefore, the stopper strip is separated from a recess of the rotating ring, the rotating ring is unlocked, the handle is lifted to the transverse direction of the notch, the rotating ring is moved through the handle so as to drive the adapter cap to rotate, the through hole in the adapter cap is aligned with the through hole in the receiving cap, the bottle cap is opened, and then the product in the bottle body can flow into the empty bottle below through the liquid flow hole to achieve subpackaging. After subpackaging, the handle is loosened to close the bottle cap, and the empty bottle is taken out; and under the action of the reset spring on the stopper, the stopper strip moves upward again to fit into the recess of the rotating ring, so as to realize self-locking of the handle.

Beneficial effects: 1. The invention has an exquisite structure, solves the problem that traditional subpackaging equipment occupies a large area, and allows subpackaging equipment to be used in stores to meet the customization requirement of customers and realize subpackaging experience of customers.

2. The switch structure of the invention adopts a self-locking structure, and the self-locking switch is ingeniously designed with a handle and a stopper, the stopper is arranged at the bottom of the adapter cap and is protected against accidental touches, and the stopper strip can be separated from the handle only when the bottle body is screwed to the adapter cap, thus avoiding waste.

DESCRIPTION OF EMBODIMENTS

The implementation of the technical scheme will be further described in detail with attached drawings. The following embodiments are only used to illustrate the technical scheme of the invention more clearly, but cannot be used to limit the protection scope of the invention.

Figure 1:
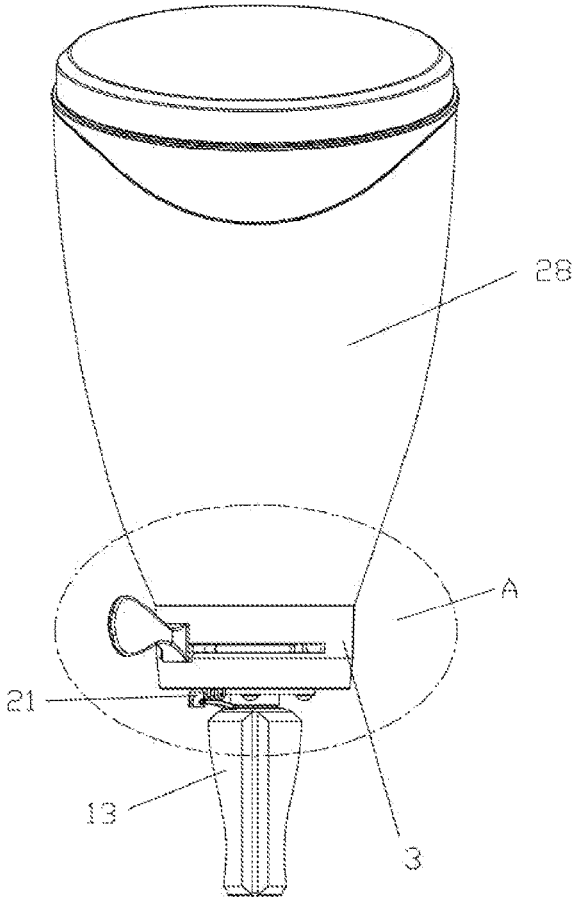
FIG. 1 is a structural diagram of the invention.
Figure 2:
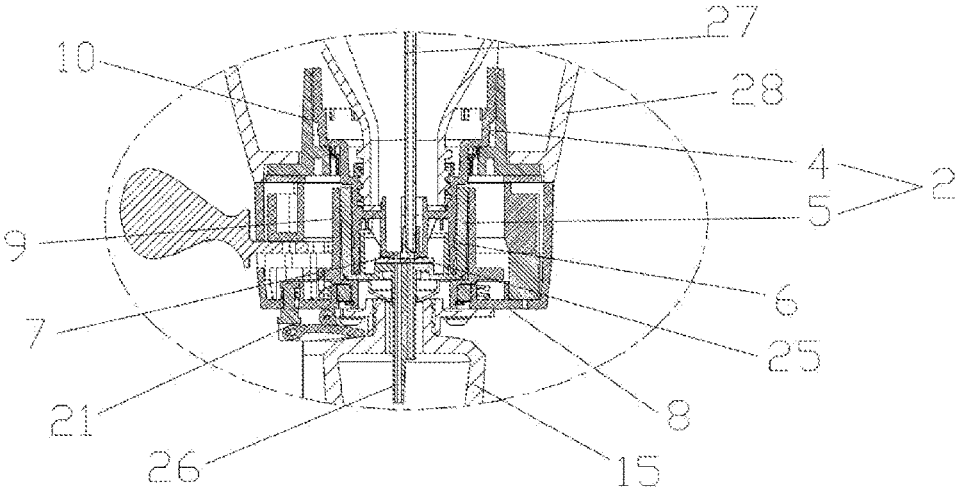
FIG. 2 is a sectional view of A in FIG. 1.
Figure 3:
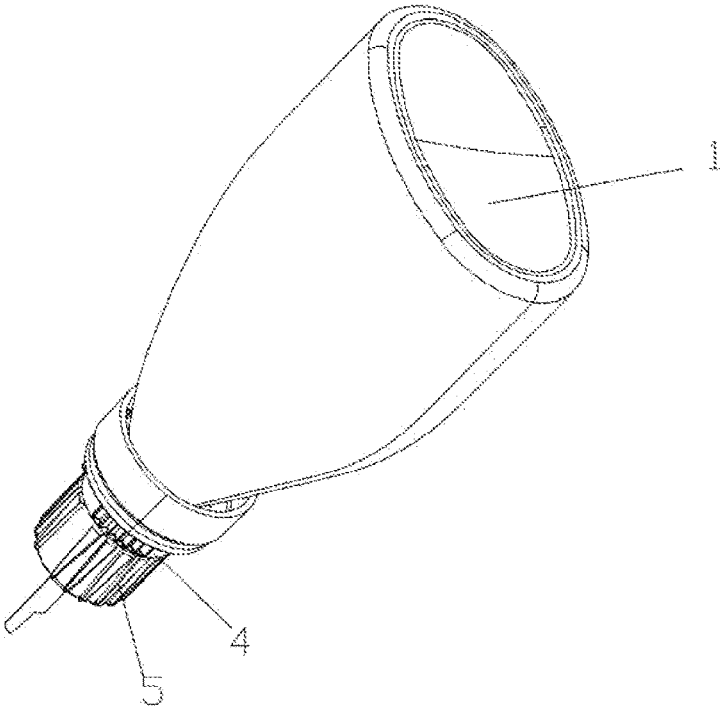
FIG. 3 is a structural diagram of a bottle body in the invention.
Figure 4:
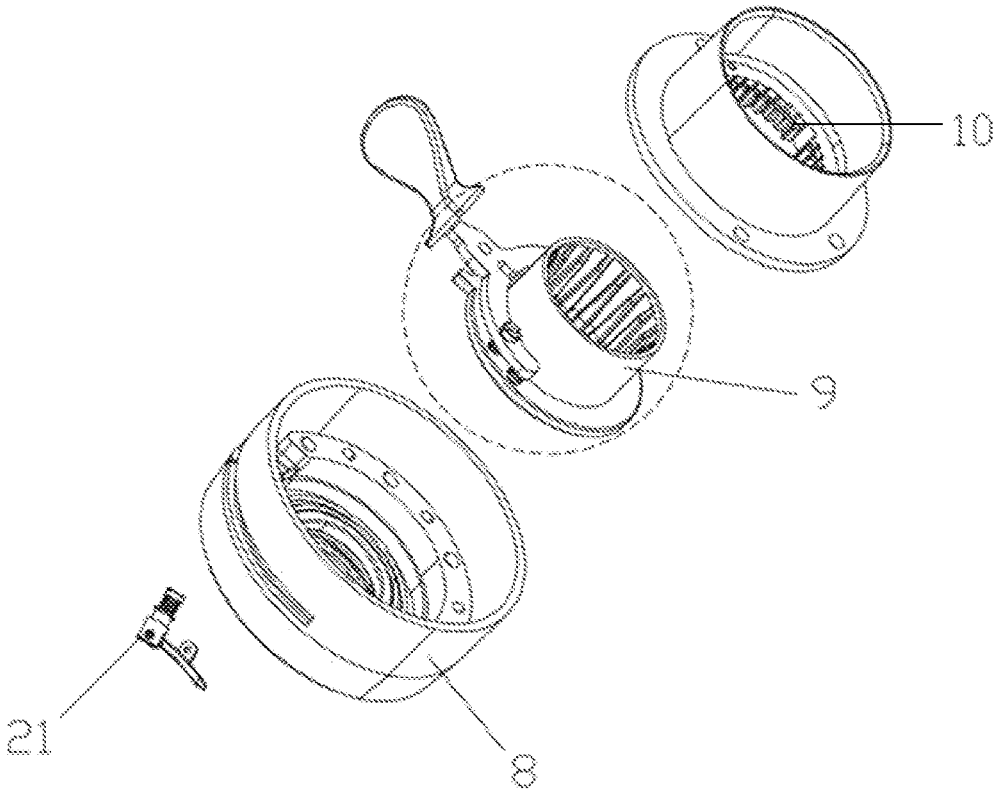
FIG. 4 is an explosive view of a bottle cap in the invention.
Figure 5:
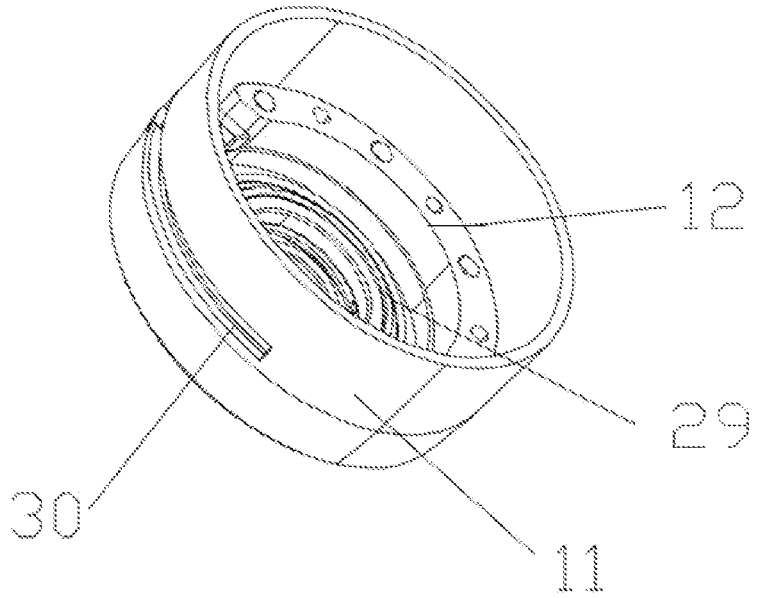
FIG. 5 is a structural diagram of an adapter cap in the invention.
Figure 6:
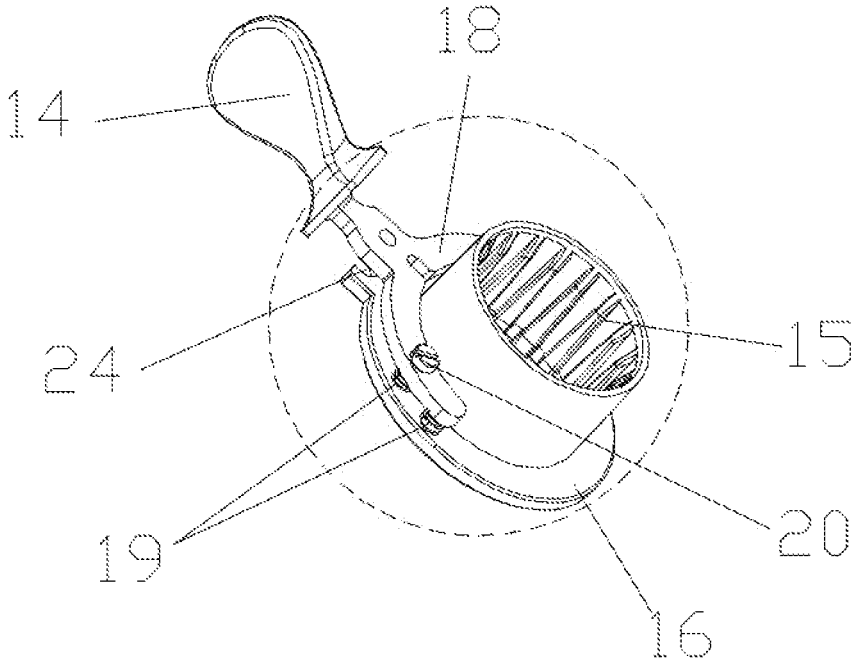
FIG. 6 is a structural diagram of a rotating ring in the invention.
Figure 7:
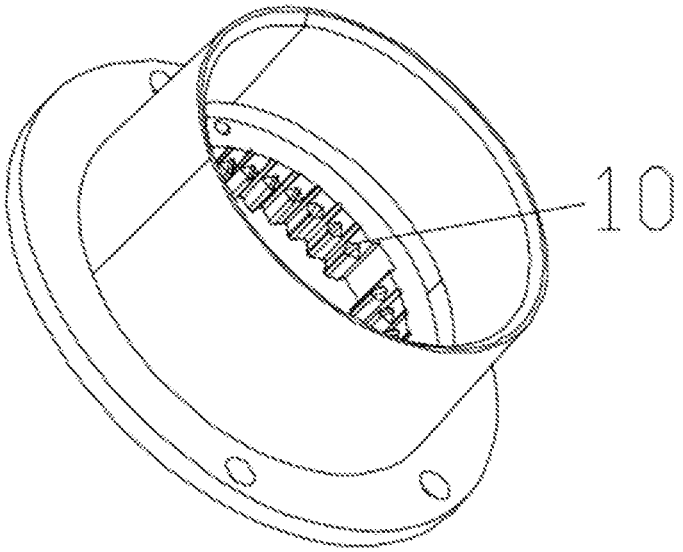
FIG. 7 is a structural diagram of a fixing ring in the invention.
Figure 8:
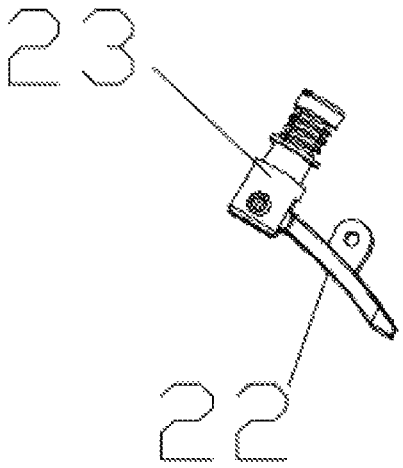
FIG. 8 is a structural diagram of a stopper in the invention.
Figure 9:
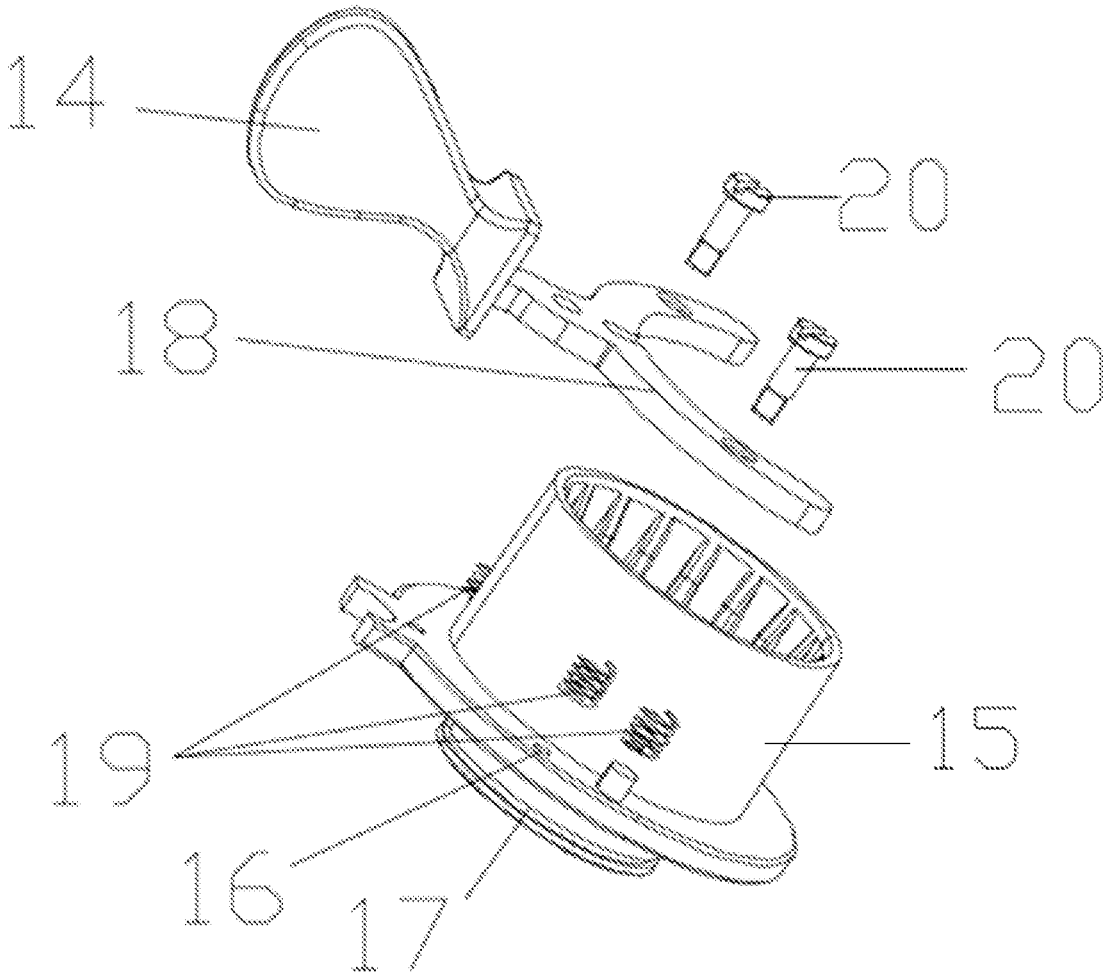
FIG. 9 is an explosive view of a rotating ring in the invention.

In an embodiment as shown in FIGS. 1-3, a self-locking subpackaging bottle comprises a bottle body 1, a bottle cap 2 and an adapter 3.

When this embodiment is implemented, the bottle body 1 and the adapter 3 are arranged on a holder 28 in an inverted manner, the bottle body 1 is arranged inside the holder 28, the adapter 3 is fixedly connected to the holder, and the bottle body 1 is fixed by the holder 28 after being arranged in an inverted manner.

The bottle cap 2 comprises a receiving cap 4 and a rotating cap 5, wherein the receiving cap 4 and the rotating cap 5 are sequentially arranged at a front end of the bottle body 1, a snap joint 6 is arranged between the receiving cap 4 and the rotating cap 5, and the rotating cap 5 is sleeved outside a front end of the receiving cap 4; through holes 7 are formed in the receiving cap 4 and the rotating cap 5, and the receiving cap 4 is connected to the bottle body 1 through an internal thread for fixing the bottle cap 2; and only when the through holes formed in the receiving cap 4 and the rotating cap 5 are aligned, can a product inside the bottle body 1 flow out. The product in this embodiment may be a liquid product such as perfume.

As shown in FIGS. 4-7, the adapter 3 comprises an adapter cap 8, a rotating ring 9 and a fixing ring 10 which are coaxially connected, wherein the adapter cap 8 comprises an annular cap 11, a support ring 12 and a first bearing 13, the first bearing 13 is arranged on an inner wall of the annular cap 11, the support ring 12 is arranged above the first bearing 13, and the rotating ring 9 is rotatably connected to the interior of the annular cap 11 through the first bearing 13; the fixing ring 10 is connected to the interior of the annular cap 11 through the support ring 12, an inner wall of the rotating ring 9 meshes with an outer wall of the rotating cap 5, an inner wall of the fixing ring 10 meshes with an outer wall of the receiving cap 4, and the positions of the fixing ring 10 and the receiving cap 4 are fixed; and the rotating ring 9 is used to drive the rotating cap 5 to rotate, and the bottle body 1 will not rotate after the bottle cap 2 and the adapter 3 mesh.

The diameter of the outer wall of the receiving cap 4 is greater than that of the rotating cap 5, which allows the rotating cap 5 to easily extend downward into the inner wall of the rotating ring 9, and the receiving cap 4 directly fits to the fixing ring 10 above the rotating ring 9.

The bottom of the inner wall of the annular cap 11 is provided with an internal thread for connecting an empty bottle 29.

The rotating ring 9 comprises a handle 14, a first rotating sleeve 15, a connecting body 16 and a second rotating sleeve 17, wherein the first rotating sleeve 15 and the second rotating sleeve 17 are respectively connected to two sides of the connecting body 16, the handle 14 is connected to the connecting body 16, and gear teeth are arranged inside the first rotating sleeve; the first rotating sleeve meshes with the outer wall of the rotating cap, the connecting body 16 is connected to the first bearing through the second rotating sleeve 17, the annular cap 11 is provided with a notch 30, and the handle 14 extends out of the adapter cap 8 from the notch 30; and the handle 14 drives the whole rotating ring 9 to rotate, and the rotating ring 9 drives the rotating cap 5 to rotate.

In this embodiment, the notch 30 can be designed as a quarter of an arc, which is matched with the through holes on the receiving cap 4 and the rotating cap 5 in a staggered manner, and the total angle of the two parts is designed as 90 degrees, that is, the bottle cap can be opened after the handle moves by the length of the notch. The angle between the through hole in the receiving cap and the through hole in the rotating cap can also be designed as other angles.

An end, connected to the connecting body 16, of the handle 14 is designed as an arc-shaped piece 18, the connecting body 16 is connected to a limit screw 20, a round hole is formed in the arc-shaped piece 18, and the diameter of the round hole is greater than that of the limit screw 20; an elastic piece 19 is arranged between the connecting body 16 and the arc-shaped piece 18, two groups of elastic pieces 19 are respectively arranged at two ends of the arc-shaped piece, and the elastic pieces 19 are designed as springs; the inner elastic piece 19 is connected through a limit screw, and the outer elastic piece is connected through a connecting post; the limit screw 20 is sleeved in a spring, the limit screw 20 is similar to a fulcrum or can be understood as a rotating shaft, and the handle 14 can move up and down around this fulcrum; and an outer end of the arc-shaped piece 18 is supported by an outer spring, so that a handle 14 end of the arc-shaped piece 18 stays in a downward state, ensuring that the handle 14 falls into the other end of a notch of the connecting body 30 and is locked.

A stopper 21 is hinged to the outside of the adapter cap 8 and comprises a connecting strip 22 and a stopper strip 23, the middle of the connecting strip 22 is hinged to the outside of the adapter cap 8, the stopper strip 23 is arranged at one end of the connecting strip 22, and extends to the rotating ring 9 through a stopper opening formed in the adapter cap 8, the connecting body 16 of the rotating ring 9 is provided with a recess 24 matched with the stopper strip 23, and a reset spring is arranged between the stopper strip 23 and the annular cap 11.

The stopper strip 23 is arranged in the diameter direction of the adapter cap 8, and the stopper strip 23 is arranged at an end away from the adapter cap 8.

A sealing gasket 25 is arranged between the receiving cap 4 and the rotating cap 5, the sealing gasket 25 is provided with a through hole 7, which is aligned with the through hole 7 on the receiving cap 4, and the through hole 7 on the rotating cap 5 is movable relative to the through hole 7 on the receiving cap 4; the through hole 7 comprises an air flow hole and a liquid flow hole; when the through hole 7 on the rotating cap 5 is misaligned with the through hole 7 on the receiving cap 4, the bottle cap 2 is closed; only when the rotating cap 5 rotates and the inner through hole 7 is aligned with the through hole 7 on the receiving cap 4, can the bottle cap 2 be in an open state; the liquid flow hole is directly designed in the receiving cap 4, a liquid guide tube 26 is arranged under the liquid flow hole, and a liquid outlet of the liquid guide tube 26 extends to the empty bottle 29 below; and the air flow hole is connected to an air guide tube 27, and an air port at the other end of the air guide tube 27 is at an air position of the inverted bottle body 1.

In this embodiment, after the bottle body is filled with the product, the rotatable bottle cap is rotatably installed on the bottle body, and then the bottle is installed on the adapter. When a customer wants to buy the product, a small empty bottle is installed on the adapter and connected to a screw thread at the bottom of the adapter cap. When the empty bottle rotates and rises, a bottle body of the empty bottle touches the hinged stopper, and the position of the connecting strip on the side of the bottle body rises and the position on the side of the stopper strip falls. Therefore, the stopper strip is separated from a recess of the rotating ring, the rotating ring is unlocked and moved through the handle so as to drive the adapter cap to rotate, the through hole in the adapter cap is aligned with the through hole in the receiving cap, the bottle cap is opened, and then the product in the bottle body can flow into the empty bottle below through the liquid flow hole to achieve subpackaging. After subpackaging, the handle is loosened to close the bottle cap, and the empty bottle is taken out; and under the action of the reset spring on the stopper, the stopper strip moves upward again to fit into the recess of the rotating ring, so as to realize self-locking of the handle.

The invention has an exquisite structure, solves the problem that traditional subpackaging equipment occupies a large area, and allows subpackaging equipment to be used in stores to meet the customization requirement of customers and realize subpackaging experience of customers.

The switch structure of the invention adopts a self-locking structure, and the self-locking switch is ingeniously designed with a handle and a stopper, the stopper is arranged at the bottom of the adapter cap and is protected from accidental touches, and the stopper strip can be separated from the handle only when the bottle body is screwed to the adapter cap; further, the handle of the application fits downwards into an initial end of an L-shaped groove by pulling the elastic piece, which limits lateral displacement, realizes double self-locking and avoids waste.

The above are only preferred embodiments of the invention, and it should be pointed out that those of ordinary skill in the art can make several improvements and variations without departing from the technical principle of the invention, and these improvements and variations should also be considered within the scope of protection of the invention.

What is claimed is:

1. A self-locking subpackaging bottle, comprising: a bottle body, a bottle cap and an adapter, wherein:

the bottle body has a front end and a bottom end, wherein the front end and the bottom end are opposite ends of the bottle body;

the bottle cap comprises a receiving cap and a rotating cap, the receiving cap and the rotating cap are sequentially arranged at the front end of the bottle body, the rotating cap is rotatably sleeved outside a front end of the receiving cap, the front end of the receiving cap is an end of the receiving cap that is relatively away from the bottom end, and the receiving cap and the rotating cap are provided with through holes;

the adapter comprises an adapter cap, a rotating ring and a fixing ring which are coaxially connected, the adapter cap comprises an annular cap, a first bearing and a support ring, the first bearing is arranged on an inner wall of the annular cap, the support ring is arranged above the first bearing, the rotating ring is rotatably connected to an interior of the annular cap through the first bearing, and the fixing ring is connected to the interior of the annular cap through the support ring; and an inner wall of the rotating ring meshes with an outer wall of the rotating cap, and an inner wall of the fixing ring meshes with an outer wall of the receiving cap.

2. The self-locking subpackaging bottle according to claim 1, wherein a diameter of the outer wall of the receiving cap is larger than a diameter of the outer wall of the rotating cap.

3. The self-locking subpackaging bottle according to claim 1, wherein a bottom of the inner wall of the annular cap is provided with an internal thread.

4. The self-locking subpackaging bottle according to claim 1, wherein the rotating ring comprises a handle, a first rotating sleeve, a connecting body and a second rotating sleeve, the first rotating sleeve and the second rotating sleeve are respectively connected to two sides of the connecting body, the handle is connected to the connecting body, the connecting body is connected to the first bearing through the second rotating sleeve, a notch is formed in the annular cap, and the handle extends out of the adapter cap from the notch.

5. The self-locking subpackaging bottle according to claim 1, wherein an end, connected to the connecting body, of the handle is designed as an arc-shaped piece, the connecting body is connected to a limit screw, a round hole is formed in the arc-shaped piece, a diameter of the round hole is greater than that of the limit screw, and an elastic piece is arranged between the connecting body and the arc-shaped piece.

6. The self-locking subpackaging bottle according to claim 1, wherein a stopper is hinged to the adapter cap and comprises a connecting strip and a stopper strip, a middle of the connecting strip is hinged to the adapter cap, the stopper strip is arranged at one end of the connecting strip, and extends to the rotating ring through a stopper opening formed in the adapter cap, a recess matched with the stopper strip is formed outside the rotating ring, and a reset spring is arranged between the stopper strip and the annular cap.

7. The self-locking subpackaging bottle according to claim 6, wherein the stopper strip is arranged in a diameter direction of the adapter cap, and the stopper strip is arranged at an end away from the adapter cap.

8. The self-locking subpackaging bottle according to claim 1, wherein a sealing gasket is arranged between the receiving cap and the rotating cap, the sealing gasket is provided with a through hole, which is aligned with the through hole in the receiving cap, the through hole in the rotating cap is movable relative to the through hole in the receiving cap, and the through hole comprises an air flow hole and a liquid flow hole.

9. The self-locking subpackaging bottle according to claim 1, wherein the receiving cap is connected to the bottle body through an internal thread.

* * * * *